United States Patent [19]

Welsh

[11] Patent Number: 4,462,387

[45] Date of Patent: Jul. 31, 1984

[54] KITCHEN EXHAUST APPARATUS

[75] Inventor: Clarke T. Welsh, Logansport, Ind.

[73] Assignee: Logansport Distributors, Inc., Logansport, Ind.

[21] Appl. No.: 444,663

[22] Filed: Nov. 26, 1982

Related U.S. Application Data

[63] Continuation of Ser. No. 194,663, Oct. 6, 1980, abandoned.

[51] Int. Cl.[3] ..... F24C 15/20

[52] U.S. Cl. ..... 126/299 R

[58] Field of Search ..... 126/299 F, 299 R, 299 D; 98/115 R, 115 LH

[56] References Cited

U.S. PATENT DOCUMENTS

| | | | |
|---|---|---|---|
| 4,043,319 | 8/1977 | Jensen | 126/299 D |
| 4,047,519 | 9/1977 | Nett | 126/299 D |
| 4,122,834 | 10/1978 | Jacobs | 126/299 D |
| 4,143,645 | 3/1979 | Blumberg | 126/299 D |
| 4,200,087 | 4/1980 | Welsh | 126/299 R |

*Primary Examiner*—Larry Jones

*Attorney, Agent, or Firm*—Woodard, Weikart, Emhardt & Naughton

[57] ABSTRACT

A kitchen exhaust apparatus is disclosed herein which comprises an enclosure having a bottom opening with a plate mounted in the opening to define an exhaust opening, a filter mounted within the enclosure, and air inlet and exhaust means for directing air from outside the enclosure to the exhaust opening and subsequently through the filter and out of the enclosure. In another aspect there is disclosed a combination cooking unit and exhaust apparatus mounted above the cooking unit.

8 Claims, 2 Drawing Figures

KITCHEN EXHAUST APPARATUS

This application is a continuation of application Ser. No. 194,663, filed Oct. 6, 1980, now abandoned.

BACKGROUND OF THE INVENTION

1. Field of the Invention

The present invention relates generally to kitchen exhaust systems, and more particularly to a system especially adaptable to wall or island installations.

2. Description of the Prior Art

Many and various types of devices have been proposed for kitchen exhaust functions. The shape and location of air inlets and outlets have been changed to accomplish various exhaust characteristics. However, there has been a continuing desire to provide improved exhaust units to remove odors and other air borne material from cooking units. A particular consideration is the introduction of minimal volumes of air from outside the building to minimize heating or cooling of the make-up air and to reduce power requirements and sizes of associated air handling components.

In U.S. Pat. No. 4,200,087, issued on Apr. 29, 1980, I disclosed a removable flow director for a kitchen exhaust system. In that system, air is introduced to the area behind the cooking unit and exhausted through a hood including an inlet of the flow director toward the front of the unit. The flow director provided a high velocity adjacent the inlet to cause enhanced scavenger action for fumes and the like, and also provided low velocity adjacent the air filters to permit effective filtering of the exhaust air.

A variety of exhaust vents including filtering means are disclosed in the prior art. In U.S. Pat. Nos. 3,978,777 and 4,047,519, issued to Nett on Sept. 7, 1976 and Sept. 13, 1977, respectively, there are disclosed ventilating apparatus including an exhaust hood for mounting above a grill or the like. In the Nett apparatus, outside air is forced through a narrow, horizontal slot at the front of the apparatus and directed rearwardly and upwardly across the open space adjacent the area to be vented, through a grease filter and into an exhaust chamber. Similar devices are shown in U.S. Pat. Nos. 4,129,121, issued to Dorius on Dec. 12, 1978; 3,890,087, issued to Kaufman et al. on June 24, 1975; 3,800,689, issued to Brown on Apr. 2, 1974; 3,400,649, issued to Jensen on Sept. 10, 1968; 3,292,525, issued to Jensen on Dec. 20, 1966; and 3,260,189, issued to Jensen on July 12, 1966.

Other hoods and venting devices are also known in the art. A ventilating hood for food cooking devices, but including no filtering means, is disclosed in U.S. Pat. No. 3,411,428, issued to Ahlrich on Nov. 19, 1968. A stove hood is shown in U.S. Pat. No. 415,003, issued to Hornor et al. on Feb. 6, 1894. Related hoods are discussed in U.S. Pat. Nos. 3,530,784, issued to Courchesne on Sept. 29, 1970 and 1,465,652, issued to Moore on Aug. 21, 1923. A simple fume hood is shown in U.S. Pat. No. 3,897,046, issued to Weese et al. on July 29, 1975. Another fume hood of the type adapted for use in chemical labs and having an auxiliary air supply is disclosed in U.S. Pat. No. 3,408,914, issued to Bayern on Nov. 5, 1968. The Bayern device includes horizontal slots at the top and bottom of the rear wall to receive the exhausted air, but does not provide for filtering of the air received through such slots.

SUMMARY OF THE INVENTION

Briefly described in one aspect of the present invention, there is provided a kitchen exhaust apparatus comprising an enclosure having a bottom opening, a plate mounted to the enclosure to cover a portion of the bottom opening and to define an exhaust opening, means for filtering air passed through the enclosure, air inlet means for directing air from outside of the enclosure to the exhaust opening, and air exhaust means for directing air from the exhaust opening through the filter means and out of the enclosure. In a related aspect, the present invention provides a combination cooking unit and exhaust apparatus including an enclosure mounted adjacent and above a cooking unit and including air inlet and exhaust means spaced substantially above the cooking unit.

It is an object of the present invention to provide a kitchen exhaust apparatus which efficiently removes fumes, grease and the like from the kitchen air and exhausts the air, after filtering, to the outside.

Another object of the present invention is to provide a kitchen exhaust apparatus which is simple in construction, and which includes convenient means for access to replace the filters, and for other servicing and maintenance work.

It is a further object of the present invention to provide a kitchen exhaust apparatus including a plurality of exhaust outlets and associated filtering means.

Further objects and advantages of the present invention will become apparent from the description of the preferred embodiment which follows.

DESCRIPTION OF THE PREFERRED EMBODIMENT

Figure 1:
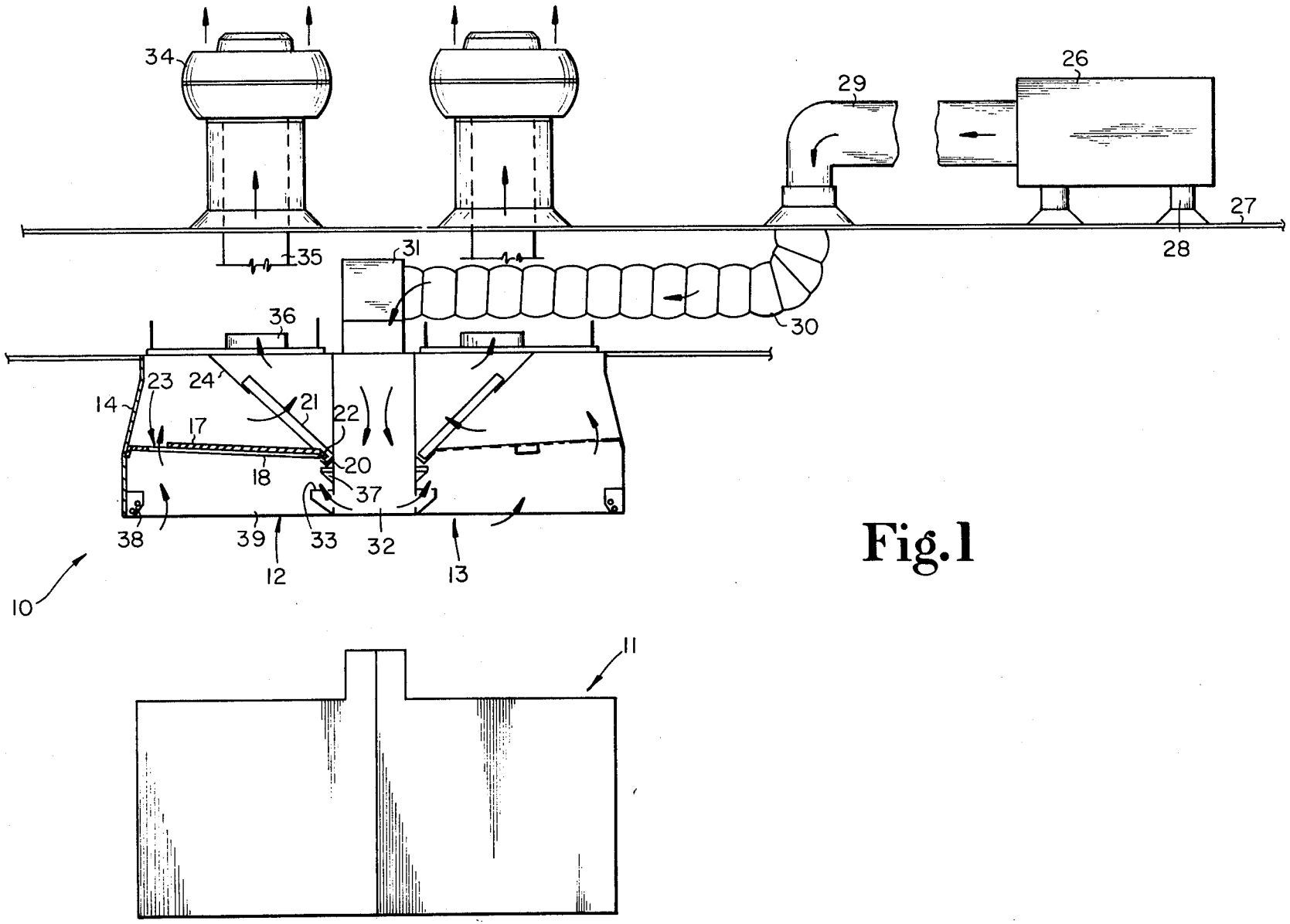
FIG. 1 is a side, cross-sectional view, partially in schematic form, of the kitchen exhaust apparatus of the present invention in combination with a cooking unit.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1, there is shown a kitchen exhaust apparatus 10 constructed in accordance with the present invention, and shown in combination with a pair of cooking units 11. The exhaust apparatus 10 is shown to have a pair of exhaust units, indicated generally at 12 and 13. Both of these exhaust units 12 and 13 are substantially identical, and detailed description will therefore only be given for the exhaust unit 12.

Figure 2:
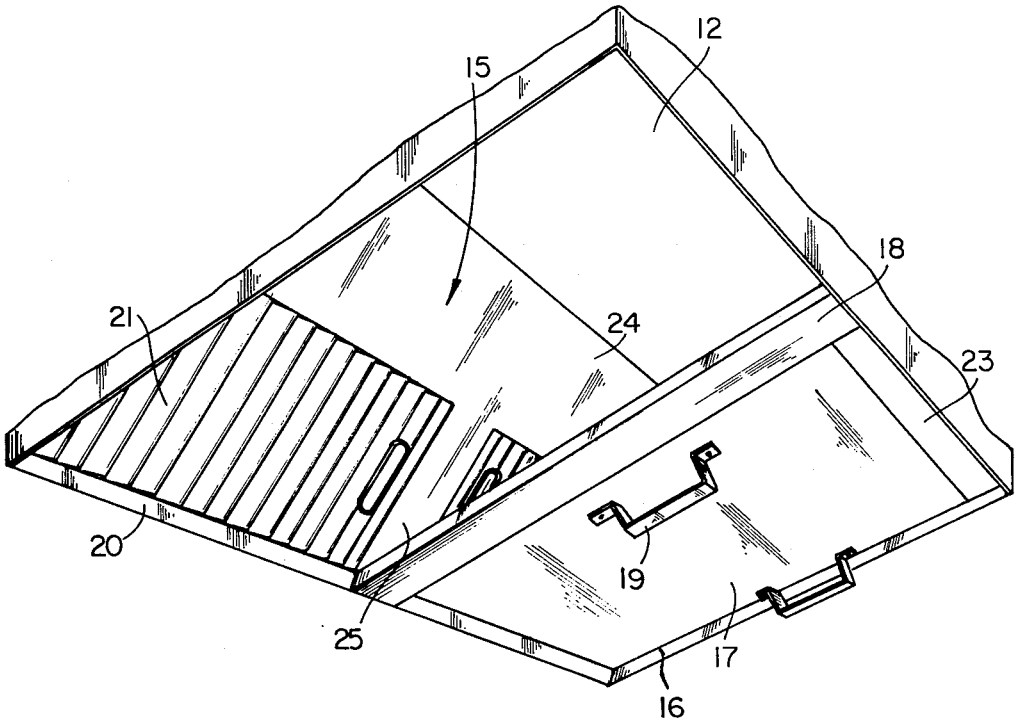
FIG. 2 is a bottom, perspective view of the kitchen exhaust apparatus of the present invention showing one of the plates removed to reveal the interior details.

Exhaust unit 12 includes an enclosure 14 having an open bottom 15 (FIG. 2). Means are provided for removably mounting flat plates to the enclosure to cover a portion of the bottom opening. A rim 16 extends about the open bottom and a plate 17 is received upon and supported about a portion of the rim. Preferably, the rim 16 may be defined in part by cross members 18. The plates 17 are preferably rectangular, flat members and may conveniently include a handle 19 to facilitate placement of the plates upon the rim, and removal therefrom.

An L-shaped flange 20 is secured to the interior of the enclosure and is preferably employed to support the plate 17 as well as a filter 21. Plate 17 may therefore desirably include an angled portion 22 for reception within the flange 20. Plate 17 is sized to provide an exhaust opening 23 with the enclosure. Means are also preferably provided for adjusting the size of the exhaust opening 23. Such means may be readily provided, for example, by using different sized plates 17, or by modifying the design to permit the plate to move to open or close the exhaust opening 23 without creating an opening at the end adjacent the angled portion 22.

Filter means are provided within the enclosure to filter air that passes through the enclosure. Such filter means preferably includes a filter 21 removably mounted within the enclosure. As is shown in the preferred embodiment, the filter 21 is preferably supported at the bottom end by the L-shaped flange 20, and at the top end by a second flange 24 secured to the top interior of the enclosure. In the case of multiple units such as shown in FIG. 2, it would also be preferable to include cross members 25 for extending between the sides of the filters.

Air inlet means are provided for directing air from outside the enclosure to the exhaust opening. Preferably, the air is brought in from outside of the kitchen, particularly from outside of the building, so that there is no increased burden on the heating or cooling requirements for the building. As shown in a preferred embodiment, there is included a fan unit 26 mounted on the roof 27 of the building with support rails 28. The fan unit is connected through a rigid duct 29 and flexible duct 30 to a plenum 31. The plenum communicates with a duct 32 extending between the enclosures of the exhaust units 12 and 13. Duct 32 includes an air inlet opening 33 preferably located below and adjacent the plate 17 on the side of the plate opposite the exhaust opening 23. The outside air is moved by the fan unit 26 through the associated ductwork and thereby through the inlet opening 33. The inlet opening is preferably oriented to direct the air moving through the inlet opening in the direction of the exhaust opening 23. As it passes between these openings, the air will draw the room air and associated fumes, grease, odors, etc. through the exhaust opening and into the enclosure.

Air exhaust means are also provided for directing the air from the exhaust opening through the filter means and out of the enclosure. As shown in the preferred embodiment, there are provided exhaust fans 34 connected through associated ductwork 35 to an opening 36 at the top of the enclosure. These exhaust fans operate to draw air into the enclosure through the exhaust opening 23, and thereafter through the filter 21 and associated ductwork to the outside of the building.

In order to obtain maximized efficiency of the filtering means within the enclosure, it is preferable that the filter have a through-flow area which is substantially larger than the exhaust opening. The flange 20 and therefore the filter 21 is positioned on the side of the plate 12 opposite the exhaust opening and a relatively large flow volume is provided between the exhaust opening and the filter. In this manner, the air will be drawn through the exhaust opening at a relatively high velocity which makes the capturing of the room odors, grease, etc. highly efficient. Following the passage of the air through the exhaust opening, the large flow area leading to and through the filter 21 will cause the air to move at a substantially reduced rate, thereby permitting a maximized efficiency of the filter as the air passes relatively slowly therethrough.

As shown in the drawings, it is an aspect of the present invention that the exhaust apparatus is combined with a cooking unit in the manner that the enclosure is mounted adjacent and above the cooking unit. It will be appreciated that a single unit 12, or multiple unit, could be mounted as well to a wall above a cooking unit received against the wall. It is also a feature of the present invention that the enclosure, and more particularly the inlet and exhaust openings be spaced substantially above the cooking unit. The efficient operation of the exhaust apparatus, particularly as described with respect to the flow rates of air associated with the exhaust apparatus, makes it possible to position the exhaust apparatus spaced substantially above the cooking unit while obtaining the desired effectiveness. At the same time, the ability to place the exhaust apparatus at this spaced above location makes the unit more readily used in existing operations since modifications to the cooking units themselves and their locations are typically not required. Also, this makes the exhaust apparatus more desirable in that the apparatus is located out of the way of the kitchen personnel.

It will be appreciated that certain modifications or additions to the preferred embodiment of the exhaust apparatus may be employed without departing from the present invention. For example, it is desirable to provide a grease trough 37 secured to the inside of the enclosure below the flange 20. In this position, grease and other materials trapped by the filter 21 may flow downwardly through the filter and be received within the grease trough for periodic removal. It may also be desirable in certain installations to include fluorescent or other types of lights 38 mounted to the exhaust apparatus. As shown, it is desirable to have an apron 39 extend downwardly beyond the location of the plate 17 to further enhance the efficiency of the exhaust apparatus by having the air passing through the inlet opening 33 move within the protection of this apron 39 in its progression to the exhaust opening 23.

What is claimed is:

1. A kitchen exhaust apparatus which comprises:

an enclosure having a bottom opening:

a substantially flat plate having opposed sides and opposed ends, said plate being sized smaller than the bottom opening of said enclosure;

mounting means for removably mounting said plate to said enclosure to cover only a portion of the bottom opening, said mounting means comprising a rim extending about at least a portion of the bottom opening, the opposed sides of said plate resting upon the rim, said enclosure and said plate defining an exhaust opening between a portion of said enclosure and an end of said plate, the end of said plate which defines the exhaust opening being unsupported by said enclosure, said mounting means further being for positioning said plate with the end being at different distances from the portion of said enclosure to provide an exhaust opening of different sizes;

filter means within said enclosure for filtering air moved through said enclosure, said filter means including a filter having a through-flow area substantially larger than the exhaust opening;

air inlet means for directing air from outside of said enclosure to the exhaust opening; and air exhaust means for directing air from the exhaust opening through said filter means and out of said enclosure.

2. The apparatus of claim 1 and which includes a flange secured to the interior of said enclosure, a portion of said plate being supported by said flange, the filter being supported by said flange.

3. The apparatus of claim 2 and which includes a grease trough secured to said enclosure below said flange.

4. The apparatus of claim 2 in which the flange is positioned on the side of said plate opposite the exhaust opening.

5. The apparatus of claim 4 and which includes a second flange secured to the top interior of said enclosure, the filter also being supported by said second flange.

6. The apparatus of claim 1 and which includes means for adjusting the size of the exhaust opening.

7. The apparatus of claim 1 in which said air inlet means includes a duct having an inlet opening located below and adjacent said plate.

8. The apparatus of claim 7 in which the inlet opening is located on the side of said plate opposite the exhaust opening.

* * * * *